US006598533B1

(12) United States Patent
Kölbli

(10) Patent No.: US 6,598,533 B1
(45) Date of Patent: Jul. 29, 2003

(54) ELECTRONIC TIME-FUSE FOR A PROJECTILE

(75) Inventor: Bertram Kölbli, Frankfurt (DE)

(73) Assignee: Honeywell AG (DE)

( * ) Notice: Subject to any disclaimer, the term of this patent is extended or adjusted under 35 U.S.C. 154(b) by 0 days.

(21) Appl. No.: 10/069,591

(22) PCT Filed: Aug. 26, 2000

(86) PCT No.: PCT/EP00/08321

§ 371 (c)(1),
(2), (4) Date: Feb. 27, 2002

(87) PCT Pub. No.: WO01/16551

PCT Pub. Date: Mar. 8, 2001

(30) Foreign Application Priority Data

Aug. 31, 1999 (DE) ..... 199 41 301

(51) Int. Cl.[7] ..... F23Q 7/02; F23Q 21/00; F42C 21/00; F42C 15/00; F42C 15/34; F42C 15/24; F42C 17/00

(52) U.S. Cl. ..... 102/215; 102/206; 102/221; 102/222; 102/247; 89/6; 89/6.5

(58) Field of Search ..... 89/6, 6.5; 102/202.5, 102/206, 215, 218, 221, 222, 247, 248, 249, 262, 264

(56) References Cited

U.S. PATENT DOCUMENTS 3,106,160 A * 10/1963 Harnau et al. ..... 102/207
4,320,704 A * 3/1982 Gawlick et al. ..... 102/218
4,454,815 A * 6/1984 Beck ..... 102/206
4,480,550 A * 11/1984 Abt ..... 102/215
4,685,396 A * 8/1987 Birse et al. ..... 102/206
4,750,424 A * 6/1988 Hau ..... 102/200
4,799,429 A * 1/1989 LaBudde et al. ..... 102/393
5,293,153 A 3/1994 Rochette et al. ..... 340/438
5,335,598 A * 8/1994 Lewis et al. ..... 102/218
5,343,795 A * 9/1994 Ziemba et al. ..... 89/6.5
5,473,986 A * 12/1995 Hau ..... 102/206
5,497,704 A * 3/1996 Kurschner et al. ..... 102/264
5,705,766 A * 1/1998 Farace et al. ..... 102/215

FOREIGN PATENT DOCUMENTS

DE 3821912 1/1990
DE 3926585 3/1991
DE 39 26 585 C 3/1991
DE 42 40 263 12/1993
DE 42 40 263 C 12/1993
DE 692 11 638 1/1997

OTHER PUBLICATIONS

MIL–STD–1316E, Jul. 10, 1998, Department of Defense Design Criteria Standard: Fuze Design Safety Criteria.*

* cited by examiner

*Primary Examiner*—Michael J. Carone
*Assistant Examiner*—H. A. Blackner
(74) *Attorney, Agent, or Firm*—Wenderoth, Lind & Ponack, L.L.P.

(57) ABSTRACT

The invention aims to increase the overflight safety of a projectile, comprising a time-fuse which has an acceleration-activated battery. To this end, the safety device actuates a switch, whose position is interrogated during the flight phase and the fuse function is deactivated, if the switch is not in the correct position.

19 Claims, 1 Drawing Sheet

ELECTRONIC TIME-FUSE FOR A PROJECTILE

BRIEF SUMMARY OF THE INVENTION

The present invention relates to an electronic projectile time detonator according to the preamble of patent claim 1. Such a detonator can be found, for example in DE 42 40 263 C1. With respect to further prior art, reference is made to U.S. Pat. No. 4,454,815, DE 39 26 585 C1, DE 38 21 912 A1 and DE 692 11 638 T2.

BACKGROUND OF THE INVENTION

Currently modem electronic detonators preferably employ for the energy supply batteries, which are only mechanically-chemically activated through the great accelerations which occur when firing a projectile. This has the advantage that detonators equipped thus do not require maintenance with respect to replacement, for example of an otherwise employed battery primary cell, since these batteries are entirely passive during their storage and therefore permit long storage times. The projectile detonators equipped therewith are therefore more favorable with respect to the detonator structure, the operating life costs and the logistics than comparable detonators equipped with, for example, primary cells.

In general in the case of time detonators equipped thus the operating sequence of the previously programmed detonator running time is started through the activation of the battery, i.e. by running up the battery voltage during the mechanical-chemical activation through the launching accelerations. This type of start of the running time first also has the advantage that a separate sensor for the detection of the firing in the detonator becomes superfluous which leads to further simplification of the detonator structure.

Such time detonators, which for reasons of overflight safety in general have no impact function, are employed for initiating the breakup of a cargo-projectile, which ejects secondary munitions. Since, especially in the case of employment by the artillery, one's own troops are also overshot, the requirements with respect to safety against too early a projectile breakup (overflight safety) are in general very high. Known numbers for the maximum permitted probability of too early a breakup are between $10^{-5}$ and $10^{-6}$.

In order to be able to attain such values, in the detonator electronics several measures are conventionally taken. These constructional measures extend from the application of redundant acceleration-proof oscillators, which are intended to prevent too quickened an operating sequence of the detonator running time of an individual erroneously operating oscillator, up to detonator circuits which are charged with ignition energy only very late, shortly before the point in time of the breakup.

The possibly erroneous (too early) point in time of the breakup of a projectile, however, is not only a function of the potential effects during the flight, but can also emanate from an erroneous firing command, erroneous programming of the detonator running time and erroneous start of the detonator running time in the detonator.

The two cases listed first cannot be corrected by measures in the detonator and will not be further considered here. The case listed last of the erroneous (too early) start of the detonator running time is the point of departure for the proposed improvement with respect to overflight safety.

The activatable batteries employed must constructionally be laid out such that they reliably activate within the entire temperature range even with extremely small propellant charge during the firing. On the other hand, they must withstand mechanical loading through environmental tests (for example 1.5 m drop onto steel plate) and the acceleration during the loading process without activating. Therewith by necessity the constructionally required safety margins between activation and nonactivation grow small. In addition, individual faults in the battery, which emanate from defective battery fabrication or material faults, can reduce these reserves further.

According to the above statements it can also not be excluded that such batteries already activate before the shot. If the time detonator had not been programmed before the battery activation, such an occurrence is in general only a problem of the total reliability of the detonator, for this detonator would remain without function (inactive) when later employed.

If, in contrast, it was previously programmed, with the electronics layout conventionally used up to now the detonator starts with the finishing out of the mission program, i.e. starting the running time, charging of the ignition circuits and detonation.

Before the launch, in the barrel and within a defined distance in front of the barrel (forward-of-barrel safety) the detonation of the projectile is in general prevented by a mechanical (or electronic) safety device. This safety device is laid out such that unintentional (mechanical-pyrotechnical) safety releasing processes can only occur with very low probability ($10^{-7}$ and lower).

After the regular safety releasing process of the safety device, the ignition means are in ignition position and contacted. If detonation occurs now, it leads to a breakup of the projectile. With the correct start of the running time through the launch, the breakup occurs in the intended target area.

However, if the running time was unintentionally started earlier, the breakup occurs correspondingly earlier i.e. on the ballistic path since the same programmed time span is being finished out. This unintended breakup point can thus practically be shifted backward on the complete flight trajectory up to the forward-of-barrel safety area. In particular in the case of the employment of cargo munitions conventionally used for time detonators this leads to considerable endangerment of one's own overshot troop formations.

Especially with faulty batteries, the unintended earlier start of the running time function can already occur through the acceleration processes during the loading (ramming home) of the projectile. It can be assumed that the activation of the battery during the loading process cannot be excluded with a probability of $10^{-5}$ to $10^{-6}$.

When employing such detonators on previously conventional guns, which, especially in proving operation, achieve only minor shot sequences, the described safety problems have been reduced through on-path breakup, possibly through the relatively long times between ramming home of the projectile (possibility of erroneous battery activation) and firing through the inhibiting effect of the safety device. If the time between the ramming home of the projectile and the firing of the projectile is longer than the programmed flight time, the electric ignition means thus ignites already in the barrel and a further igniting through is in this case prevented through the safety setting of the safety device.

However, guns used widely today are loaded and fired automatically. The time processes are here shorter, i.e. the times between automatic ramming home of the projectile and the firing are shorter or comparable to the set detonator running times. For that reason, on such guns for electronic time detonators (with activatable battery) within prior art, the probability of on-path breaking up is increased.

Building on this prior art, the task of the present invention is therefore specifying an electronic projectile time detonator, which strongly reduces the probability of on-path breaking up.

BRIEF DESCRIPTION OF THE DRAWING

The solution of this task succeeds according to the electronic projectile time detonator characterized in patent claim 1. An advantageous embodiment of the projectile time detonator according to the invention is evident in the dependent claims. In the following, the electronic projectile time detonator according to the invention will be briefly explained in conjunction with the attached FIG. 1.

DETAILED DESCRIPTION OF THE INVENTION

Figure 1:
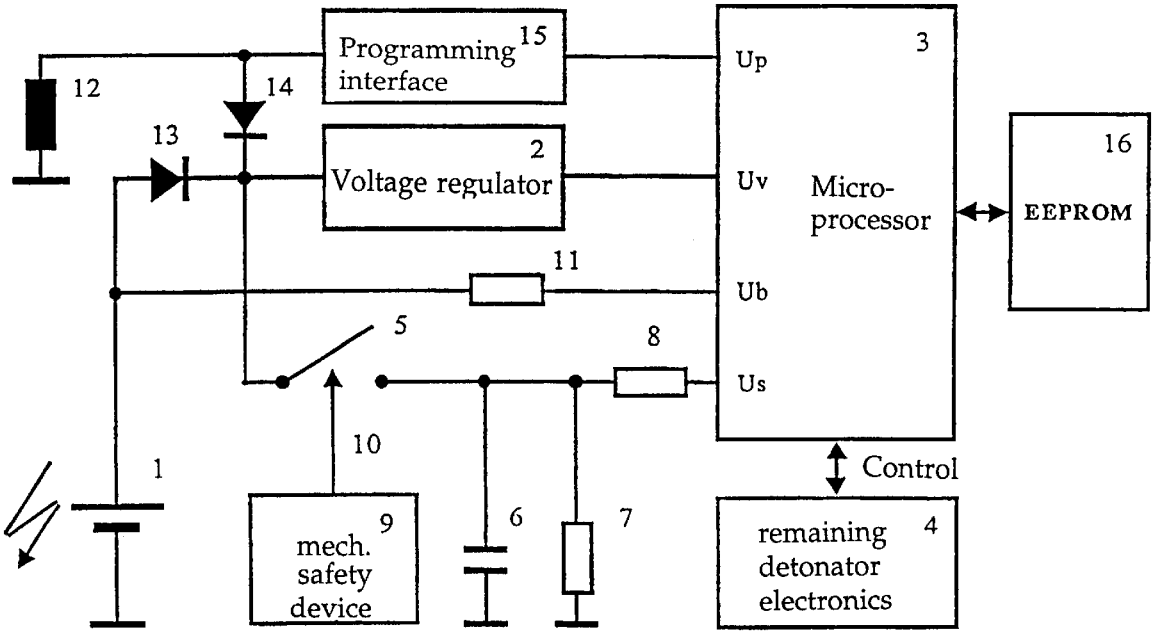

To an acceleration-activated battery 1 is connected a voltage regulator 2 via a decoupling diode 13, which supplies the detonator electronics and specifically here a microprocessor 3 with the operating voltage Uv. In the microprocessor the flight program programmed into an Electrically Erasable Programmable Read-Only Memory (EEPROM) 16 via an inductively operating interface 12, 15 is finished out and initiates the detonation at the suitable point in time via the balance of detonator electronics 4.

During the inductive programming the acceleration-activated battery 1 is not yet activated. Therefore the operating voltage Uv necessary for the programming process is derived via a diode 14 and the voltage regulator 2 from the energy of the inductive programming. The recognition of the two operating modes 'programming/flight' takes place via a resistor 11 with the voltage level at microprocessor port Ub. If there is no voltage present here, the battery is not yet activated (the programming voltage is held remote by the decoupling diode 13 from port Ub) and the microprocessor recognizes upon the occurrence of Uv the programming and processes the corresponding programming sequences at port Up. However, if the battery is activated, at port Ub level High is present and the microprocessor 3 finishes out its programmed flight program.

In addition to the supply via an activated battery and the diode 13 in the flight phase or via a programming coil 12 and the diode 14 in the programming phase, the input voltage of the voltage regulator 2 is conducted across a switch 5 and the RC combination 6, 7 and 8 to the input port Us of microprocessor 3. The switch 5 is actuated via a suitable mechanical actuation device 10 through the mechanical safety device 9. In the case under consideration it is open if the safety device is in the safety position and it is closed in the armed position.

Due to this configuration in programming the detonator the first advantage of the method is already obtained. In the programming through the microprocessor 3 the port Us is also queried. If the switch is open, i.e. if the safety device is in safety position, no voltage is connected to Us and the programming can be carried out as provided. However, if during the programming process the switch 5 is closed, i.e. if the safety device is in armed position, the input voltage of the voltage regulator is placed across resistor 8 to the port Us of the microprocessor. In this case level High is connected and the programming is suppressed. Since the programming in general takes place bidirectionally, in this case this hazardous state of the safety device can also be reported back to the programming apparatus and thus to the operator and consequently can provide instructions for the further handling of the detonator.

Thereby requirement 4.6.6 of the detonator safety standard MIL-STD 1316 D can be elegantly fulfilled, which requires an external checking capability of the safety state of the safety device before installation of the detonator into the munitions. This checking can thereby be carried out via an already present interface, the programming interface, and thus requires no additional expensive measures such as viewing window or break-throughs on the detonator housing.

The second advantage (main advantage) of the method improves the overflight safety of the detonator or of the projectile. Upon the shot, the acceleration-activated battery 1 is activated during the barrel passage phase. The detonator electronics is thereby supplied with energy and the microprocessor 3, after stabilization of the operating voltage Uv, starts with the finishing out of the programmed flight program. Here also the program sequence is dependent on the voltage state of port Us.

This voltage state depends on the mechanical closing of switch 5 by the mechanical safety device. At the shot, the mechanical safety device closes switch 5 via the mechanical activation device 10. On the other hand, it prevents reliably the closing in the presence of briefly acting environmental forces, which emanate from environmental loading. However, if the environmental forces of a regular shot are present, the switch 5 closes at least briefly. Even if switch 5 subsequently again opens through accelerations during the exit of the projectile from the barrel mouth, through the capacitor 6 the state of the switch obtaining in the barrel is intermediately stored (for the capacitor 6 is charged during the barrel passage phase through the battery activating in the barrel) until the microprocessor 3 interconnects after the stabilization of its operating voltage Uv (this is the case approximately 20–100 m after leaving the barrel mouth). The resistor 8 ensures the adaptation of the higher voltage level of the acceleration-activated battery 1 to the voltage level of the microprocessor. Across resistor 7 the DC current path for the CMOS input port of the microprocessor 3 is closed for the case that during the query of the port the switch 5 is opened (a low input DC current must always be able to flow).

If the voltage Us during the port query by the software during the flight phase represents the state High (thus, for example, if, at an operating voltage of Uv=5 V, the voltage Us is above 2.6 V), the flight program is finished out regularly which ends with the detonation of the explosive substance.

If during the query the state Us=low, the software concludes that an unintentional activation of the battery is present and the further finishing out of the flight program is prevented. The detonator, and thus the projectile, in this case remains inactive. Thereby the overflight safety of the munitions is ensured.

As a third advantageous property of the method this event of unintentional activation of the battery can be stored in EEPROM 16 such that it is nonvolatile. With a repeat programming of the detonator by querying of this information it is subsequently possible to determine whether or not the battery had already (unintentionally) activated during the storage, transport or handling phases and therefore is no longer available for the planned mission. In this way an additional means is obtained for a further going quality control of the "One Shot" component acceleration-activated battery.

What is claimed is:

1. Electronic projectile time detonator with an electronic control unit (3), which with a first input ($U_p$) is connected to a programming interface (12, 15) for the input of a time program, with a voltage regulator (2) which supplies the electronic control unit (3) from programming information or via an acceleration-activated battery (1) at a second input ($U_v$) with voltage, and with a mechanical safety device (9, 10) which enables an ignition stage upon its activation, characterized in that a switch (5) actuated by the mechanical safety device (9, 10) is disposed, which connects the input of the voltage regulator (2) with a third input ($U_s$) of the electronic control unit (3), with a finishing out of the time program becoming only possible with the actuated switch (5).

2. Electronic projectile time detonator as claimed in claim 1 with inductive programming by means of an induction coil (12), characterized in that the induction coil (12) and the acceleration-activated battery (1) are each connected across decoupling diodes (14, 13) to the input of the voltage regulator (2).

3. Electronic projectile time detonator as claimed in claim 2, characterized in that the input of the voltage regulator (2) is connected across the switch (5) and an RC storage element (6, 7, 8) to the third input ($U_s$) of the electronic control unit (3).

4. Electronic projectile time detonator as claimed in claim 3, characterized in that the acceleration-activated battery (1) is connected across a resistor (11) to a fourth input ($U_b$) of the electronic control unit (3), with a high potential being required at this fourth input for the finishing out of the time program.

5. Electronic projectile time detonator as claimed in claim 1, characterized in that the electronic control unit (3) permits a programming of an ignition time only if programming pulses are present at the first input ($U_p$) and the second input ($U_v$) has a high level.

6. Electronic projectile time detonator as claimed in claim 1, characterized in that the electronic control unit (3) permits the finishing out of the time program only if the third input ($U_s$) and a fourth input ($U_b$) have high potential.

7. Electronic projectile time detonator as claimed in claim 3, characterized in that the third input ($U_s$) is queried during the finishing out of a flight program and blocks an ignition function if the switch does not have a correct switch position.

8. Electronic projectile time detonator as claimed in claim 3, characterized in that the third input is also queried during the programming of the electronic projectile time detonator and deactivates the programming function if the switch does not have a correct switch position.

9. Electronic projectile time detonator as claimed in claim 3, characterized in that an incorrect switch position is indicated to an operator via a report-back channel of the programming function.

10. Electronic projectile time detonator as claimed in claim 3, characterized in that an incorrect switch position is stored during the finishing out of a flight program and a succeeding programming is deactivated based on this information.

11. Electronic projectile time detonator as claimed in claim 10, characterized in that a nonvolatile stored information about an earlier battery activation is indicated to an operator across a report-back channel of the programming function.

12. Electronic projectile time detonator as claimed in claim 1, characterized by a microprocessor (3) as electronic control unit.

13. Electronic projectile time detonator as claimed in claim 12, characterized in that a nonvolatile store is connected to the microprocessor (3) in which a programmed ignition time is stored.

14. Electronic projectile time detonator as claimed in claim 2, characterized in that the electronic control unit (3) permits the programming of an ignition time only if programming pulses are present at the first input ($U_p$) and the second input ($U_v$) has a high level.

15. Electronic projectile time detonator as claimed in claim 3, characterized in that the electronic control unit (3) permits the programming of an ignition time only if programming pulses are present at the first input ($U_p$) and the second input ($U_v$) has a high level.

16. Electronic projectile time detonator as claimed in claim 4, characterized in that the electronic control unit (3) permits the programming of an ignition time only if programming pulses are present at the first input ($U_p$) and the second input ($U_v$) has a high level.

17. Electronic projectile time detonator as claimed in claim 2, characterized in that the electronic control unit (3) permits the finishing out of the time program only if the third input ($U_s$) and a fourth input ($U_b$) having a high potential.

18. Electronic projectile time detonator as claimed in claim 3, characterized in that the electronic control unit (3) permits the finishing out of the time program only if the third input ($U_s$) and a fourth input ($U_b$) having a high potential.

19. Electronic projectile time detonator as claimed in claim 4, characterized in that the electronic control unit (3) permits the finishing out of the time program only if the third input ($U_s$) and the fourth input ($U_b$) have high potential.

* * * * *